US007410935B2

(12) United States Patent
Hewette

(10) Patent No.: US 7,410,935 B2
(45) Date of Patent: Aug. 12, 2008

(54) GEAR FLUIDS

(75) Inventor: Chip Hewette, Richmond, VA (US)

(73) Assignee: Afton Chemical Corporation, Richmond, VA (US)

( * ) Notice: Subject to any disclaimer, the term of this patent is extended or adjusted under 35 U.S.C. 154(b) by 350 days.

(21) Appl. No.: 11/386,436

(22) Filed: Mar. 22, 2006

(65) Prior Publication Data

US 2007/0225182 A1 Sep. 27, 2007

(51) Int. Cl.
*C07F 9/50* (2006.01)

(52) U.S. Cl. ..... 508/564

(58) Field of Classification Search ..... 508/564
See application file for complete search history.

(56) References Cited

U.S. PATENT DOCUMENTS

| | | | |
|---|---|---|---|
| 2,063,629 | A | 12/1936 | Salzberg et al. |
| 2,224,695 | A | 12/1940 | Prutton |
| 2,447,288 | A | 8/1948 | Smith et al. |
| 2,616,905 | A | 11/1952 | Asseff et al. |
| 2,724,718 | A | 11/1955 | Stiles et al. |
| 3,812,222 | A | 5/1974 | Kleiner et al. |
| 3,984,448 | A | 10/1976 | Lippsmeier |
| 4,431,552 | A | 2/1984 | Salentine |
| 4,857,214 | A | 8/1989 | Papay et al. |
| 5,034,563 | A | 7/1991 | Ashjian et al. |

*Primary Examiner*—Walter D. Griffin
*Assistant Examiner*—Frank C Campanell
(74) *Attorney, Agent, or Firm*—Luedeka, Neely & Graham, P.C.

(57) ABSTRACT

A gear fluid composition for extreme pressure applications. The composition includes a base oil component and a friction modifier mixture. The mixture is provided by an alkyl phosphonic acid diester of the formula:

wherein $R^1$ is a hydrocarbyl group containing from about 8 to about 24 carbon atoms, $R^2$ and $R^3$ are selected from a hydrocarbyl group containing from about 1 to about 8 carbon atoms, an alkyl phosphonic acid monoester of the formula wherein $R^4$ is a hydrocarbyl group containing from about 8 to about 24 carbon atoms, $R^5$ is hydrogen or hydrocarbyl group containing from about 1 to about 8 carbon atoms, and an amine salt of a partial ester of phosphoric acid represented by the formula wherein each of $R^6$ and $R^8$ is a hydrocarbyl group, and $R^7$ is hydrogen or a hydrocarbyl group, and wherein the ratio of (i) to (ii) ranges from about 3 to about 5.5.

29 Claims, 1 Drawing Sheet

GEAR FLUIDS

FIELD

The present disclosure relates to gear and power transmission fluids having improved characteristics particularly for extreme pressure applications. The fluids disclosed herein may include fluids and additives suitable for use in a broad range of gear and transmission applications in the automotive and machinery industries.

BACKGROUND AND SUMMARY

New and advanced differential gear and transmission systems are being developed by the automotive industry. These new systems often involve high energy requirements. Therefore, component protection technology must be developed to meet the increasing energy requirements of these advanced systems.

An example of a gear apparatus is the limited slip differential. Limited slip differentials are provided in many vehicles to counteract a commonly occurring situation where one of the two driving tires or wheels is essentially void of traction. This may be in loose soil, sand, mud, or ice. In the standard open differential, the driving tire void of traction receives all of the powertrain torque, but spins without moving the vehicle in the desired direction. In a limited slip differential, a mechanism divides, or shares, a portion of the torque delivered by the powertrain with both driving wheels. By sharing the available torque, a wheel with some traction receives enough torque to move the vehicle in the desired direction. In addition, high performance vehicles have so much torque that in certain turning situations the torque on one wheel exceeds the available traction and, thus, performance suffers. The limited slip differential shares the torque between both wheels, enhancing the performance of the vehicle.

Limited slip differentials have a variety of mechanisms to provide torque transfer from the input pinion gear to the axle shafts. A common mechanism is a multi-plate wet clutch that transfers torque from the differential carrier to the side gear. These multi-plate clutches typically have a set of friction plates of one material or facing material, and a set of steel plates. One set of plates is linked through some means to the differential carrier, while the other set of plates is linked through a similar means to the side gear. As the side gear drives the axle shaft, torque is therefore transferred to the axle shaft and thereby the wheel and tire of the vehicle. This then gives a motive force to the vehicle.

In operation, the limited slip differential friction and steel clutch plates spin at different speeds with respect to one another when in a vehicle turn or when traction to one wheel is reduced or void. The relative rotational speed of the clutch plates may range from near zero revolutions per minute to very high speeds of several hundred revolutions per minute. The clutch plates are operated in most cases by a biasing spring force that pushes the two sets of plates together, as well as the differential gear set separating force.

Limited slip differentials require that the lubricant for the rear axle have proper friction characteristics, and that the friction characteristics last for a sufficient elapsed mileage or duration. The proper friction characteristic is that the friction coefficient rises with increasing plate rotational speed, and falls with decreasing plate rotational speed.

To provide the proper friction characteristics and lifetime, certain additives may be added as a top treat to the gear lubricant. These additives can be selected from a wide range of friction modifiers and related compounds. However, a particularly effective additive will not stay in solution in a top treat.

For the purposes of this disclosure, the phrase "gear fluids" is intended to include, but is not limited to, the foregoing gear and transmission systems and applications.

Gear fluids formulated according to the present disclosure are suitably formulated to protect transmission and gear drive components in metal-on-metal contact situations. However, additives which provide such improvement are difficult to maintain dissolved in a concentrate for deliverance to a gear fluid.

In an embodiment, a gear fluid composition for extreme pressure applications is provided. The gear fluid contains an base oil component and a friction modifier mixture. The friction modifier includes (i) at least one alkyl phosphonic acid diester of the formula:

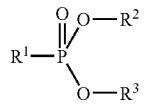

wherein $R^1$ is a hydrocarbyl group containing from about 8 to about 24 carbon atoms, $R^2$ and $R^3$ are independently selected from a hydrocarbyl group containing from about 1 to about 8 carbon atoms;

(ii) at least one alkyl phosphonic acid monoester of the formula

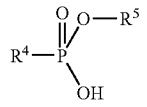

wherein $R^4$ is a hydrocarbyl group containing from about 8 to about 24 carbon atoms, $R^5$ is selected from hydrogen and a hydrocarbyl group containing from about 1 to about 8 carbon atoms; and (iii) at least one amine salt of a partial ester of phosphoric acid represented by the formula

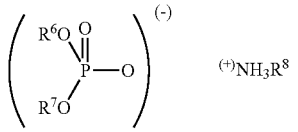

wherein each of $R^6$ and $R^8$ is, independently, a hydrocarbyl group, and $R^7$ is hydrogen or a hydrocarbyl group, and wherein the ratio of (i) to (ii) ranges from about 3 to about 5.5.

In another embodiment, there is provided a method of improving the solubility of friction modifier components in a friction modifier additive package. The method includes blending at least one alky phosphonic acid diester of the formula:

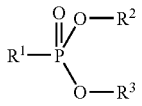

with at least one alkyl phosphonic acid monoester of the formula:

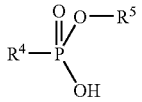

and at least one amine salt of a partial ester of phosphoric acid represented by the formula

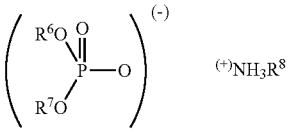

wherein $R^1$ and $R^4$ are selected from a hydrocarbyl group containing from about 8 to about 24 carbon atoms; $R^2$, $R^3$ and $R^5$ are independently selected from hydrogen and a hydrocarbyl group containing from about 1 to about 8 carbon atoms; each of $R^6$, and $R^8$ is, independently, a hydrocarbyl group; and $R^7$ is hydrogen or a hydrocarbyl group. The ratio of the diester to the monoester of the alkyl phosphonic acids in the mixture ranges from about 3 to about 5.5 and the total acid number (TAN) of the alkyl phosphonic acid diester is up to about 15. The foregoing components are blended in an amount of the base oil component sufficient to stabilize substantially all of the alkyl phosphonic acid diester and monoester.

An advantage of the compositions and methods described herein is that the components of the additive package remain substantially solubilized or stabilized in the base oil component without the need for additional solubilizing additives so that the additive package is substantially free from additive drop-out. The additive package described herein also enables a high concentration of friction modifier component to be delivered to a gear fluid. Such additive packages are particularly suitable for a wide variety of gear and/or transmission applications including, but not limited to, automotive gears, industrial gears, stationary gears, rear axles, limited slip differentials, conventional differentials, and/or automatic and manual transmissions. Further, such additive packages are suitable for use in multi-plate differentials, cone clutch differentials, torsen differentials, and/or dog clutch differentials.

BRIEF DESCRIPTION OF THE DRAWINGS

Further advantages of the exemplary embodiments may become apparent by reference to the detailed description when considered in conjunction with the figure, wherein.

DETAILED DESCRIPTION OF EMBODIMENTS

Figure 1:
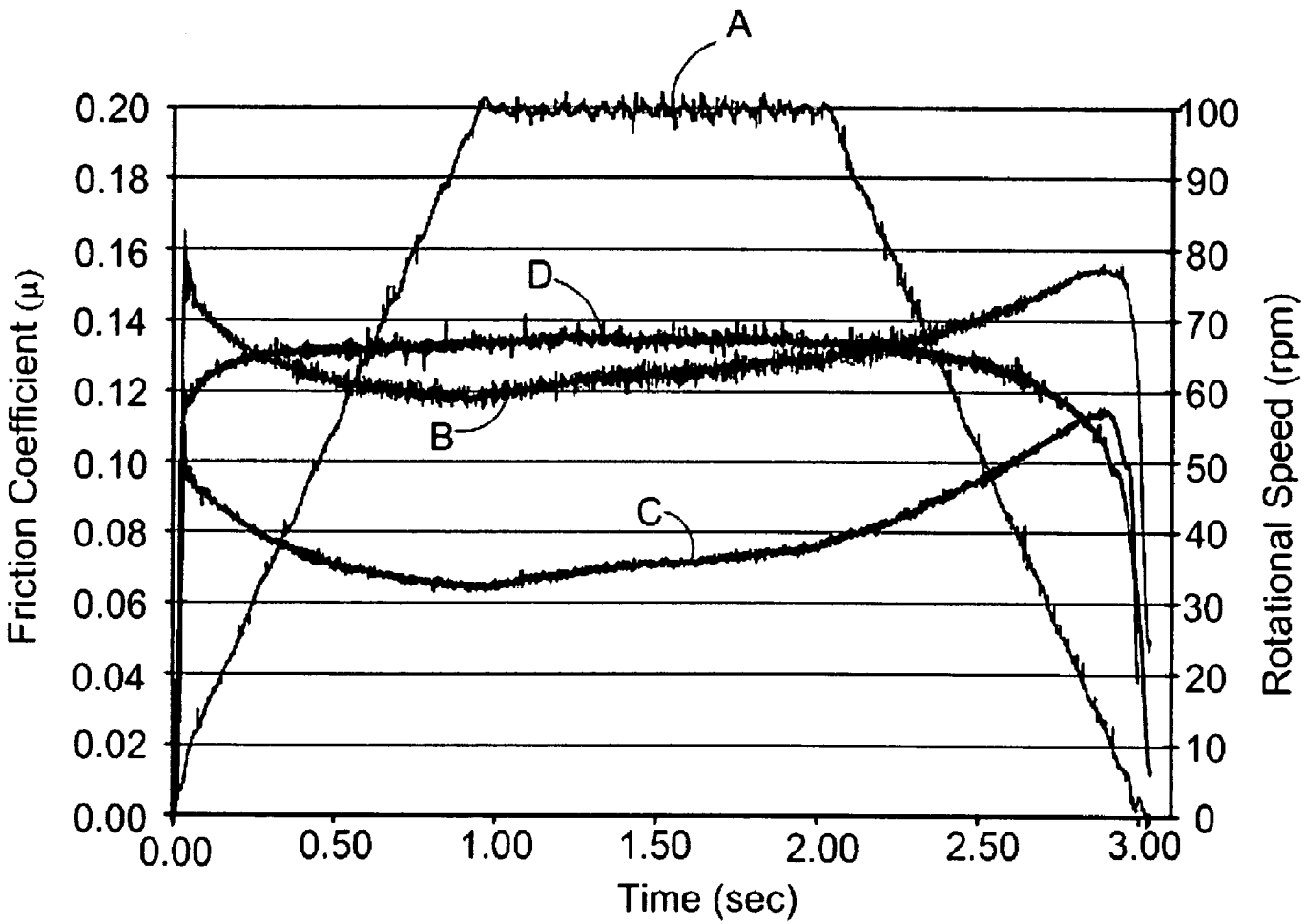
FIG. 1 is a graphical comparison of top treat compositions in a gear fluid during a friction durability test on an SAE #2 test rig.

As used herein, the term "hydrocarbyl substituent" or "hydrocarbyl group" is used in its ordinary sense, which is well-known to those skilled in the art. Specifically, it refers to a group having a carbon atom directly attached to the remainder of a molecule and having a predominantly hydrocarbon character. Examples of hydrocarbyl groups include:

(1) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form an alicyclic radical);

(2) substituted hydrocarbon substituents, that is, substituents containing non-hydrocarbon groups which, in the context of the description herein, do not alter the predominantly hydrocarbon substituent (e.g., halo (especially chloro and fluoro), hydroxy, alkoxy, mercapto, alkylmercapto, nitro, nitroso, and sulfoxy);

(3) hetero-substituents, that is, substituents which, while having a predominantly hydrocarbon character, in the context of this description, contain other than carbon in a ring or chain otherwise composed of carbon atoms. Hetero-atoms include sulfur, oxygen, nitrogen, and encompass substituents such as pyridyl, furyl, thienyl and imidazolyl. In general, no more than two, as another example, no more than one, non-hydrocarbon substituent will be present for every ten carbon atoms in the hydrocarbyl group; typically, there will be no non-hydrocarbon substituent in the hydrocarbyl group.

In exemplary embodiments described herein, a gear fluid additive may include a base oil component and a friction modifier additive composition including an ester of phosphonic acid and an amine salt of an oil soluble phosphoric acid derivative. The esters of phosphonic acid may be represented by the general formula:

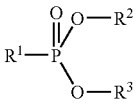

(I)

where $R^1$ is a hydrocarbyl group containing from about 8 to about 24 carbon atoms, $R^2$ and $R^3$ are independently selected from H and a hydrocarbyl group containing from about 1 to about 8 carbon atoms.

More specifically, the esters of phosphonic acid may include a fully or partially monoester of phosphonic acid and a diester of phosphonic acid. The diester of phosphonic acid may be represented by the above formula (I) wherein $R^2$ and $R^3$ are independently from a hydrocarbyl group containing from about 1 to about 8 carbon atoms. The monoester of phosphonic acid may be represented by the formula:

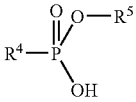

(II)

wherein $R^4$ is a hydrocarbyl group containing from about 8 to about 24 carbon atoms, and $R^5$ is selected from hydrogen and a hydrocarbyl group containing from about 1 to about 8 carbon atoms. In the above formulas (I) and (II), $R^1$ and $R^4$ may be the same hydrocarbyl group and $R^5$ may be the same hydrocarbyl group as $R^2$. Accordingly, the monoester of formula (II) may be derived from the diester of formula (I) by hydrolysis of the diester according to a procedure disclosed in U.S. Publication No. 2004/0230068 A1, the disclosure of which is incorporated herein by reference. The monoester of formula (II) may be a fully or partially hydrolyzed ester.

Whether the monoester is derived from the diester or separately made, the total amount of monoester and diester in an additive concentrate typically ranges from about 2 to about 6 percent by weight of the total weight of the concentrate. Also, the ratio of diester to monoester used in the additive concentrate is selected to provide prolonged stability of the esters in a base oil component. Typically, it is difficult to maintain the solubility of the diester in an additive concentrate. However, combining a monoester with a diester in a ratio of diester to monoester ranging from about 3 to about 5.5 greatly increases the prolonged stability of the diester in the additive package even at concentrations of the diester above 4 percent by weight.

Examples of monoesters of phosphonic acid include, but are not limited to, hexane phosphonic acid, octane phosphonic acid, dodecane phosphonic acid, tetradecane phosphonic acid, hexadecane phosphonic acid, pentadecane phosphonic acid, 2-methylpentane phosphonic acid, trimethylpentane phosphonic acid, octadecane phosphonic acid, ethane phosphonic acid, propane phosphonic acid, 2-methylpropane phosphonic acid, hexane phosphonic acid, n-heptyl ester, octane phosphonic acid 2-ethylhexyl ester, dodecane phosphonic acid ethyl ester, tetradecane phosphonic acid methyl ester, hexadecane phosphonic acid butyl ester, pentadecane phosphonic acid methyl ester, 2-methylpentane phosphonic acid ethyl ester, hexane phosphonic acid 4-methylpentyl-(2) ester, 2,4,4,-trimethylpentane phosphonic acid ethyl ester, octadecane phosphonic acid isopropyl ester, ethane phosphonic acid methyl ester, ethane phosphonic acid ethyl ester, ethane phosphonic acid isobutyl ester, propane phosphonic acid ethyl ester, and 2-methylpropane phosphonic acid isobutyl ester. The monoesters typically have a total acid number (TAN) ranging from about 100 to about 200.

Examples of diesters of phosphonic acid include, but are not limited to, hexane phosphonic acid di-n-heptyl ester, octane phosphonic acid di-2-ethylhexyl ester, dodecane phosphonic acid diethyl ester, tetradecane phosphonic acid dimethyl ester, hexadecane phosphonic acid dibutyl ester, pentadecane phosphonic acid dimethyl ester, 2-methylpentane phosphonic acid diethyl ester, hexane phosphonic acid di4-methylpentyl-(2) ester, 2,4,4,-trimethylpentane phosphonic acid diethyl ester, octadecane phosphonic acid diisopropyl ester, ethane phosphonic acid dimethyl ester, ethane phosphonic acid diethyl ester, ethane phosphonic acid di-isobutyl ester, propane phosphonic acid diethyl ester, and 2-methylpropane phosphonic acid di-isobutyl ester. Methods for making phosphonic acid esters are described in U.S. Pat. No. 2,724,718 to Siles et al. and U.S. Pat. No. 3,812,222 to Kleiner et al., for example. The diesters typically have a total acid number (TAN) up to about 15.

Another component of the friction modifier additive composition is selected from amine salts of a partial ester of phosphoric acid. Such compounds may be represented by the formula:

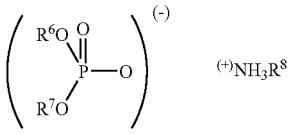

wherein each of $R^6$ and $R^8$ is, independently, a hydrocarbyl group, and $R^7$ is hydrogen or a hydrocarbyl group.

Illustrative examples of amine salts of a partial ester of phosphoric acid include, but are not limited to, the following:

Octadecylamine salt of butylphosphoric acid
Octadecylamine salt of isobutylphosphoric acid
Octadecylamine salt of amylphosphoric acid
Octadecylamine salt of hexylphosphoric acid
Octadecylamine salt of heptylphosphoric acid
Octadecylamine salt of 2-ethylhexylphosphoric acid
Octadecylamine salt of octylphosphoric acid
Octadecylamine salt of nonylphosphoric acid
Octadecylamine salt of decylphosphoric acid
Octadecylamine salt of dodecylphosphoric acid
Octadecylamine salt of tridecylphosphoric acid
Octadecylamine salt of tetradecyiphosphoric acid
Octadecylamine salt of hexadecyiphosphoric acid
Octadecylamine salt of octadecylphosphoric acid
Octadecylamine salt of oleylphosphoric acid
Octadecylamine salt of benzylphosphoric acid
Octadecylamine salt of cyclohexylphosphoric acid
Octadecylamine salt of p-tolylphosphoric acid
Octadecylamine salt of xylylphosphoric acid Octadecylamine salts or adducts have been set forth in the above two listings merely for purposes of illustration. In lieu of octadecyl amine salts, or in addition thereto, use can be made of nonylamine, decylamine, undecylamine, dodecylamine, tridecylamine, tetradecylamine, pentadecylainine, hexadecylamine, heptadecylamine, cyclohexylamine, phenylamine, mesitylamine, oleylamine, cocoamine, soyamine, $C_8$ tertiary alkyl primary amine, $C_{12-14}$ tertiary alkyl primary amine, $C_{22-24}$ tertiary alkyl primary amine, phenethylamine, etc., salts or adducts of partially estenfied phosphoric acids, including mixtures of any such compounds. Generally speaking, suitable amine salts are salts of aliphatic amines, especially the saturated or olefinically unsaturated aliphatic primary amines, such as n-octadecylamine, 2-ethyihexylamine, tert-octylamine, n-decylamine, the $C_{10}$, $C_{12}$, $C_{14}$ and $C_{16}$ tertiary alkyl primary amines (either singly or in any combinations thereof, such as a mixture of the $C_{12}$ and $C_{14}$ tertiary alkyl primary amines), n-undecylamine, a mixture of $C_{14}$ to $C_{18}$ a tertiary alkyl primary amines, lauryl amine, hexadecylamine, heptadecylamine, octadecylamine, the $C_{22}$ and $C_{24}$ tertiary alkyl primary amines (either singly or in combination), decenylamine, dodecenylamine, palmitoleylamine, oleylamine, linoleylamine, eicosenylamine, etc. Secondary hydrocarbyl amines and tertiary hydrocarbyl amines can also be used either alone or in combination with each other or in combination with primary amines. Thus any combination of primary, secondary, and/or tertiary amines, whether monoamine or polyamine, can be used in forming the salts or adducts.

Similarly, the amines used can be in the form of polyalkylene polyamines; functionally-substituted polyamines such as a succinimide or succinamide of a polyalkylene polyamine such as a polyisobutenyl succinimide of diethylene triamine, a polyisobutenyl succinimide of triethylene tetramine, a polyisobutenyl succinimide of tetraethylene pentamine, a polyisobutenyl succinimide of pentaethylene hexamine (including succinimides made from commercially available polyethylene polyamine mixtures which contain linear, branched and cyclic species); and Mannich bases derived from polyalkylene polyamines of the types just described. Moreover, the polyalkylene polyamines whether in the free state or in the form of a succinimide, succinamide, or Mannich base, can be partially boronated, partially phosphorylated, or partially acylated with a reagent such as maleic anhydride, malic acid, itaconic acid, itaconic anhydride, thiomalic acid, fumaric acid, and the like, provided that such boronated or phosphorylated or acylated amine or amine moiety contains at least sufficient residual basicity to enable it to form a salt with the partially esterified phosphoric acid. Alkylene polyamines in the form of succinimides, succinamides or Mannich bases which have been boronated and phosphorylated are described for example in U.S. Pat. No. 4,857,214.

Use of primary amines is suitable. Other suitable amines are alkyl monoamines and alkenyl monoamines having from about 8 to about 24 carbon atoms in the molecule.

Amines having less than 8 carbon atoms can be used, including methyl amine, etc., provided the resultant amine salt is oil-soluble. Likewise, amines having more than 24 carbon atoms can be used, again with the proviso that the resultant amine salt is oil soluble.

Methods for the preparation of such amine salts are well known and reported in the literature. See for example, U.S. Pat. Nos. 2,063,629; 2,224,695; 2,447,288; 2,616,905; 3,984,448; 4,431,552; and International Application Publication No. WO 87/07638.

A suitable amount of the amine salt of partial esters of phosphoric acid in the friction modifier additive composition may range from about 20 to about 40 percent by weight of the total weight of the additive composition, as another example from about 25 to about 35 weight percent, and as an even further example from about 28 to about 32 weight percent.

Synthetic Blendstock

In some embodiments, the base oil component may comprise a synthetic blendstock. The synthetic blendstock for the foregoing friction modifier additive composition may comprise an alkylated aromatic compound, for example an alkylated naphthalene. Alkylated naphthalenes may be produced by any suitable means known in the art, from naphthalene or from an alkyl-substituted naphthalene which may contain one or more short chain alkyl groups having up to about eight carbon atoms, such as methyl, ethyl, or propyl, etc. Suitable alkyl-substituted naphthalenes include alpha-methylnaphthalene, dimethylnaphthalene and ethylnaphthalene. However, alkylating a non-substituted naphthalene may provide better thermal and oxidative stability than more highly alkylated materials.

A convenient method of producing alkylated naphthalenes is disclosed in U.S. Pat. No. 5,034,563, entitled "Naphthalene Alkylation Process" and which is incorporated herein in its entirety by reference thereto. Briefly in accordance with that method, long chain alkyl substituted naphthalenes are produced by the alkylation of naphthalene with an olefin such as an alpha-olefin or other alkylating agent such as an alcohol or alkyl halide possessing at least 6 carbon atoms, or 10 to 30 carbon atoms, or 12 to 20 carbon atoms, in the presence of an alkylation catalyst comprising a zeolite which contains cations having a radius of at least 2.5 Angstroms. Cations of this size may be provided by hydrated cations such as hydrated ammonium, sodium or potassium cations or by organoammonium cations such as tetraalkylammonium cations. The zeolite is usually a large pore size zeolite USY. The presence of the bulky cations in the zeolite increases the selectivity of the catalyst for the production of long chain mono-alkyl substituted naphthalenes in preference to more highly substituted products.

The amount of synthetic blendstock in the friction modifier additive composition may range from about 50 to about 80 percent by weight of the additive.

Base Oil

Base oils suitable for use in formulating gear additive or fluid compositions according to the disclosure may be selected from any of the synthetic or natural oils or mixtures thereof. Natural oils include animal oils and vegetable oils (e.g., castor oil, lard oil) as well as mineral lubricating oils such as liquid petroleum oils and solvent treated or acid-treated mineral lubricating oils of the paraffinic, naphthenic or mixed paraffinic-naphthenic types. Oils derived from coal or shale are also suitable. The base oil typically has a viscosity of about 2 to about 15 cSt or as another example about 2 to about 10 cSt at 100° C.

The synthetic base oils include alkyl esters of dicarboxylic acids, polyglycols and alcohols, poly-alpha-olefins, including polybutenes, alkyl benzenes, organic esters of phosphoric acids, and polysilicone oils. Synthetic oils include hydrocarbon oils such as polymerized and interpolymerized olefins (e.g., polybutylenes, polypropylenes, propylene isobutylene copolymers, etc.); poly(1-hexenes), poly-(1-octenes), poly (1-decenes), etc. and mixtures thereof; alkylbenzenes (e.g., dodecylbenzenes, tetradecylbenzenes, di-nonylbenzenes, di-(2-ethylhexyl)benzenes, etc.); polyphenyls (e.g., biphenyls, terphenyl, alkylated polyphenyls, etc.); alkylated diphenyl ethers and alkylated diphenyl sulfides and the derivatives, analogs and homologs thereof and the like.

Alkylene oxide polymers and interpolymers and derivatives thereof where the terminal hydroxyl groups have been modified by esterification, etherification, etc., constitute another class of known synthetic oils that may be used. Such oils are exemplified by the oils prepared through polymerization of ethylene oxide or propylene oxide, the alkyl and aryl ethers of these polyoxyalkylene polymers (e.g., methyl-polyisopropylene glycol ether having an average molecular weight of about 1000, diphenyl ether of polyethylene glycol having a molecular weight of about 500-1000, diethyl ether of polypropylene glycol having a molecular weight of about 1000-1500, etc.) or mono- and polycarboxylic esters thereof, for example, the acetic acid esters, mixed $C_{3-8}$ fatty acid esters, or the $C_{13}$ Oxo acid diester of tetraethylene glycol.

Another class of synthetic oils that may be used includes the esters of dicarboxylic acids (e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acid, alkyl malonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoether, propylene glycol, etc.) Specific examples of these esters include dibutyl adipate, di(2-ethylhexyl)sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid and the like.

Esters useful as synthetic oils also include those made from $C_5$ to $C_{12}$ monocarboxylic acids and polyols and polyol ethers such as neopentyl glycol, trimethylol propane, pentaerythritol, dipentaerythritol, tripentaerythritol, etc.

Further, oils derived from a gas-to-liquid process are also suitable.

Hence, the base oil used which may be used to make the gear fluid compositions as described herein may be selected from any of the base oils in Groups I-V as specified in the American Petroleum Institute (API) Base Oil Interchangeability Guidelines. Such base oil groups are as follows:

| Base Oil Group[1] | Sulfur (wt. %) | | Saturates (wt. %) | Viscosity Index |
|---|---|---|---|---|
| Group I | >0.03 | and/or | <90 | 80 to 120 |
| Group II | ≦0.03 | And | ≧90 | 80 to 120 |
| Group III | ≦0.03 | And | ≧90 | ≧120 |
| Group IV | all polyalphaolefins (PAOs) | | | |
| Group V | all others not included in Groups I-IV | | | |

[1]Groups I-III are mineral oil base stocks.

The foregoing additive composition containing the esters of phosphonic acid, the amine salts of partial esters of phosphoric acid, and the base oil component may be provided as a top-treat composition to a gear fluid. The additive composition or top treat composition may be added to a gear fluid in an amount ranging from about 3 to about 10 percent by weight based on the total weight of the gear fluid.

Gear fluids that may be enhanced with such additive or top treat compositions typically include a major amount of a base oil and a minor amount of an additive composition. The additive composition may include, for example, ashless dispersants, friction modifiers, antioxidants, viscosity index improvers, corrosion inhibitors, antiwear additives, metal deactivators, antifoamants, pour point depressants, detergents metallic detergents, and/or seal swell agents.

Additives used in formulating the fluid compositions described herein can be blended into the base oil individually or in various sub-combinations. It is also suitable to blend all of the components concurrently using an additive concentrate (i.e., additives plus a diluent, such as a hydrocarbon solvent). The use of an additive concentrate takes advantage of the mutual compatibility afforded by the combination of ingredients when in the form of an additive concentrate. Also, the use of a concentrate reduces blending time and lessens the possibility of blending errors.

The gear fluids disclosed herein may include fluids suitable for a wide variety of gear and/or transmission applications including, but not limited to, automotive gears, industrial gears, stationary gears, rear axles, limited slip differentials, conventional differentials, and/or automatic and manual transmissions. Further, such additive packages are suitable for use in multi-plate differentials, cone clutch differentials, torsen differentials, and/or dog clutch differentials An exemplary composition useful as a top treat additive for a gear fluid as described above may contain the following components in the amounts indicated based on weight percent in the additive composition:

| Component | Amount |
|---|---|
| Group I-V base oil | 60-70 wt. % |
| alkenyl amine | 15-20 wt. % |
| mono-hydrocarbyl acid phosphate | 10-12 wt. % |
| dimethyloctadecylphosphonate | 4-5 wt. % |
| methyloctadecylphosphonate monoester | 0.5-1.5 wt. % |

The foregoing additive or top treat composition may be added to a gear fluid in an amount ranging from about 3 to about 10 percent by weight to provide improved fluid characteristics. Friction durability tests of the foregoing additive or top treat fluid in conventional gear fluids containing non-synthetic base oils, synthetic base oils, and a combination of non-synthetic and synthetic base oils have exhibited an increasing coefficient of friction with increasing slip speed after a 24 hour durability test on an SAE #2 test rig.

A comparison between two conventional top treat additives (Curves B and C) and a top treat additive (Curve D) according to the foregoing exemplary composition is provided graphically in FIG. 1. Each of the top treat additives were added to a conventional gear fluid that was subjected to a 24 hour durability test on a SAE #2 test rig at 100 rpm and an applied pressure of 450 KPascals. The friction coefficients for the gear fluids containing top treat additive B, C, or D at a rotational speed of 100 rpm (Curve A) are illustrated in FIG. 1. Curve D which is the friction coefficient curve for a fluid containing a top treat additive according to the disclosure (Curve D) exhibited increasing friction coefficients during the durability test, whereas the fluids containing the conventional top treat additives (Curves B and C) exhibited decreasing friction coefficients during the test cycle. Hence, it is believed that a top treat additive according to the disclosure will significantly outperform conventional top treat additives for an extended period of time.

At numerous places throughout this specification, reference has been made to a number of U.S. Patents. All such cited documents are expressly incorporated in full into this disclosure as if fully set forth herein.

Other embodiments of the present invention will be apparent to those skilled in the art from consideration of the specification and practice of the invention disclosed herein. As used throughout the specification and claims, "a" and/or "an" may refer to one or more than one. Unless otherwise indicated, all numbers expressing quantities of ingredients, properties such as molecular weight, percent, ratio, reaction conditions, and so forth used in the specification and claims are to be understood as being modified in all instances by the term "about." Accordingly, unless indicated to the contrary, the numerical parameters set forth in the specification and claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. It is intended that the specification and examples be considered as exemplary only, with a true scope and spirit of the invention being indicated by the following claims.

The invention claimed is:

1. An gear additive composition, comprising:

(a) a base oil component; and (b) a friction modifier mixture including:

(i) at least one alkyl phosphonic acid diester of the formula:

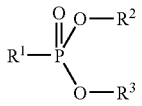

wherein $R^1$ is a hydrocarbyl group containing from about 8 to about 24 carbon atoms, $R^2$ and $R^3$ are independently selected from a hydrocarbyl group containing from about 1 to about 8 carbon atoms;

(ii) at least one alkyl phosphonic acid monoester of the formula

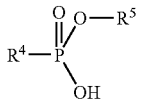

wherein $R^4$ is a hydrocarbyl group containing from about 8 to about 24 carbon atoms, $R^5$ is selected from hydrogen and a hydrocarbyl group containing from about 1 to about 8 carbon atoms; and (iii) at least one amine salt of a partial ester of phosphoric acid represented by the formula

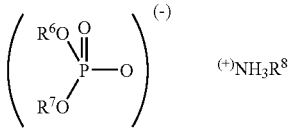

wherein each of $R^6$ and $R^8$ is, independently, a hydrocarbyl group, and $R^7$ is hydrogen or a hydrocarbyl group, and wherein the ratio of (i) to (ii) ranges from about 3 to about 5.5.

2. The additive composition of claim 1, wherein the base oil component comprises an alkylated naphthalene blendstock.

3. The additive composition of claim 1, wherein the base oil component comprises a mono-alkylated naphthalene.

4. The additive composition of claim 1, wherein the alkyl phosphonic acid diester is selected from the group consisting of dimethyloctadecylphosphonate, dimethyloctadecenylphosphonate, diethyl-2-ethyldecylphosphonate, ethylpropyl-1-butylhexadecylphosphonate, methylethyloctadecylphosphonate, methylbutyl eicosylphosphonate, dimethylhexatriacontylphosphonate.

5. The additive composition of claim 1, wherein the alkyl phosphonic acid monoester is derived from the alkyl phosphonic acid diester.

6. The additive composition of claim 1, wherein the amine salt is derived from 2-ethylhexyl acid phosphate.

7. The additive composition of claim 1, wherein the amine salt is derived from oleylamine.

8. The additive composition of claim 1, comprising from about 1 to about 10 percent by weight of the monoester and diester of phosphonic acid.

9. The additive composition of claim 1, comprising from about 10 to about 30 percent by weight of the amine salt of the phosphoric acid.

10. The additive composition of claim 1, comprising from about 50 to about 70 percent by weight of the base oil component.

11. The additive composition of claim 1, further comprising an antioxidant, an antiwear agent, an antifoam agent, and a viscosity index improver.

12. A gear fluid containing an effective amount of the additive composition of claim 1.

13. The gear fluid of claim 12, wherein the gear fluid comprises from about 3 to about 6 percent by weight of the additive composition.

14. An axle containing the additive composition of claim 1.

15. The axle of claim 14, wherein the axle comprises a limited slip differential.

16. The additive composition of claim 1, wherein the additive composition is applied to a limited slip axle as a top treat fluid.

17. A method of improving the solubility of one or more friction modifier components in a friction modifier additive package comprising blending at least one alky phosphonic acid diester of the formula:

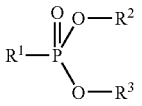

with at least one alkyl phosphonic acid monoester of the formula:

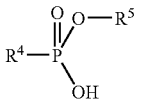

and with at least one amine salt of a partial ester of phosphoric acid represented by the formula

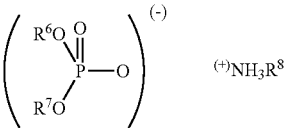

wherein $R^1$ and $R^4$ are selected from a hydrocarbyl group containing from about 8 to about 24 carbon atoms; $R^2$, $R^3$ and $R^5$ are independently selected from hydrogen and a hydrocarbyl group containing from about 1 to about 8 carbon atoms; and each of $R^6$ and $R^8$ is, independently, a hydrocarbyl group, and $R^7$ is hydrogen or a hydrocarbyl group, wherein the foregoing components are blended in an amount of a base oil component sufficient to solubilize substantially all of the alkyl phosphonic acid monoester and diester, and wherein the ratio of the diester to the monoester of the alkyl phosphonic acids ranges from about 3 to about 5.5.

18. The method of claim 17, wherein the base oil component comprises an alkylated naphthalene blendstock.

19. The method of claim 17, wherein the base oil component comprises a mono-alkylated naphthalene.

20. The method composition of claim 17, wherein the alkyl phosphonic acid diester is selected from the group consisting of dimethyloctadecylphosphonate, dimethyloctadecenylphosphonate, diethyl-2-ethyldecylphosphonate, ethylpropyl-1-butylhexadecylphosphonate, methylethyloctadecylphosphonate, methylbutyl eicosylphosphonate, dimethylhexatriacontylphosphonate.

21. The method of claim 17, wherein the amine salt is derived from 2-ethylhexyl acid phosphate.

22. The method of claim 17, wherein the amine salt is derived from oleylamine.

23. The method of claim 17, comprising mixing from about 1 to about 10 percent by weight of the alkyl phosphonic acid diester with from about 0.5 to about 1.5 percent by weight of the alkyl phosphonic acid monoester, and with from about 10 to about 30 percent by weight of the amine salt of the partial ester of phosphoric acid in the base oil component.

24. The method of claim 17, comprising blending from about 50 to about 70 percent by weight of the base oil component with the alkyl phosphonic acid monoester, with the alkyl phosphonic acid diester, and with the amine salt of the partial ester of phosphoric acid.

25. A top-treat additive package made by the method of claim 17.

26. A method for improving the friction performance of a gear fluid comprising providing an additive package to a gear fluid, the additive package comprising a base oil component and a friction modifier mixture including:

(i) at least one alkyl phosphonic acid diester of the formula:

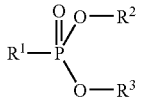

wherein $R^1$ is a hydrocarbyl group containing from about 8 to about 24 carbon atoms, $R^2$ and $R^3$ are independently selected from a hydrocarbyl group containing from about 1 to about 8 carbon atoms;

(ii) at least one alkyl phosphonic acid monoester of the formula

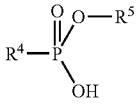

wherein $R^4$ is a hydrocarbyl group containing from about 8 to about 24 carbon atoms, $R^5$ is selected from hydrogen and a hydrocarbyl group containing from about 1 to about 8 carbon atoms; and (iii) at least one amine salt of a partial ester of phosphoric acid represented by the formula

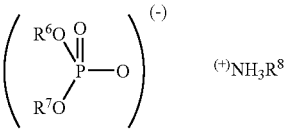

wherein each of $R^6$ and $R^8$ is, independently, a hydrocarbyl group, and $R^7$ is hydrogen or a hydrocarbyl group, and wherein the ratio of (i) to (ii) ranges from about 3 to about 5.5.

27. The method of claim 26, wherein the additive package is suitable for use in a limited slip differential.

28. The method of claim 26, wherein the gear fluid comprises from about 0.03 to about 0.5 percent by weight of the alkyl phosphonic acid diester based on the total weight of the gear fluid.

29. The method of claim 26, wherein the additive packages is added to the gear fluid in an amount ranging from about 1 to about 10 percent of the total weight of the gear fluid.

* * * * *